US008122795B2

(12) United States Patent
Goll

(10) Patent No.: US 8,122,795 B2
(45) Date of Patent: Feb. 28, 2012

(54) METHOD FOR MAKING AN ELASTOMERIC SEALING DEVICE

(75) Inventor: Kevin O. Goll, Park Ridge, IL (US)

(73) Assignee: Mar Don Corporation, Park Ridge, IL (US)

( * ) Notice: Subject to any disclaimer, the term of this patent is extended or adjusted under 35 U.S.C. 154(b) by 418 days.

(21) Appl. No.: 12/350,912

(22) Filed: Jan. 8, 2009

(65) Prior Publication Data

US 2009/0158911 A1 Jun. 25, 2009

Related U.S. Application Data

(63) Continuation-in-part of application No. PCT/US2007/073160, filed on Jul. 10, 2007.

(60) Provisional application No. 60/819,857, filed on Jul. 10, 2006.

(51) Int. Cl.
*B26D 1/00* (2006.01)
*B26D 3/08* (2006.01)

(52) U.S. Cl. ..... 82/1.11; 82/123

(58) Field of Classification Search ..... 82/1.11, 82/123, 127, 128, 18, 173; 493/285; 83/880, 83/733

See application file for complete search history.

(56) References Cited

U.S. PATENT DOCUMENTS

| | | | | |
|---|---|---|---|---|
| 1,582,683 | A * | 4/1926 | Harmon | 29/602.1 |
| 2,932,083 | A * | 4/1960 | De Nicolo | 29/417 |
| 4,246,813 | A * | 1/1981 | Grachev et al. | 82/127 |
| 5,048,382 | A * | 9/1991 | Mitchell | 82/1.11 |
| 5,964,016 | A * | 10/1999 | Ito et al. | 29/27 C |
| 6,957,817 | B2 * | 10/2005 | Goll | 277/603 |

* cited by examiner

*Primary Examiner* — Will Fridie, Jr.

(74) *Attorney, Agent, or Firm* — Marshall, Gerstein & Borun LLP

(57) ABSTRACT

An improved method of producing elastomeric sealing devices having a plurality of removable concentric sizing rings is provided wherein the size of said first face is increased to create an extended elastomeric mounting face such that the cross-sectional area of the first face disposed against said chuck is at least 150% of the cross-sectional area of the body of said device.

4 Claims, 5 Drawing Sheets

FIG. 1
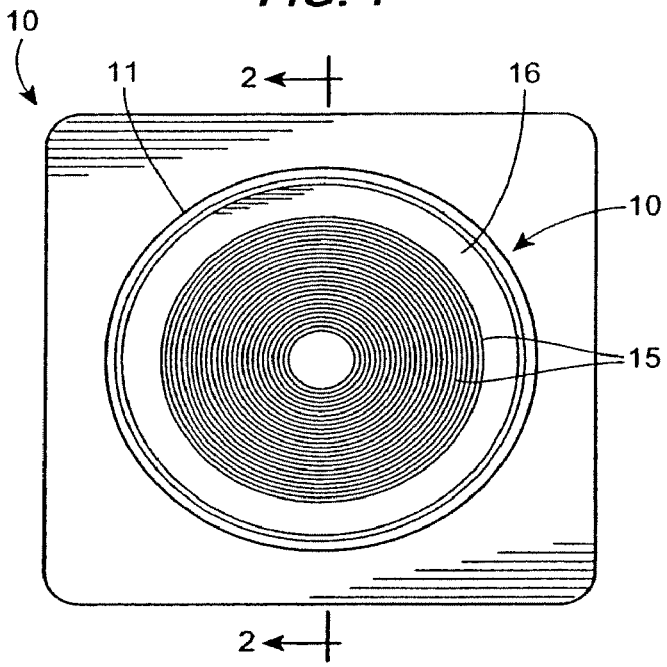
FIG. 2
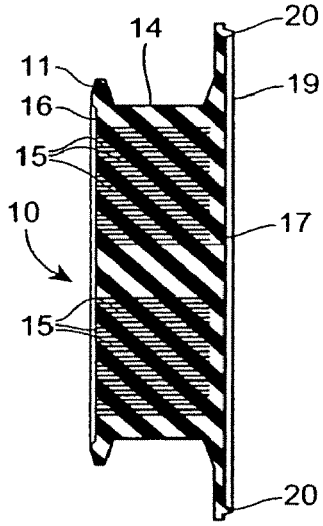
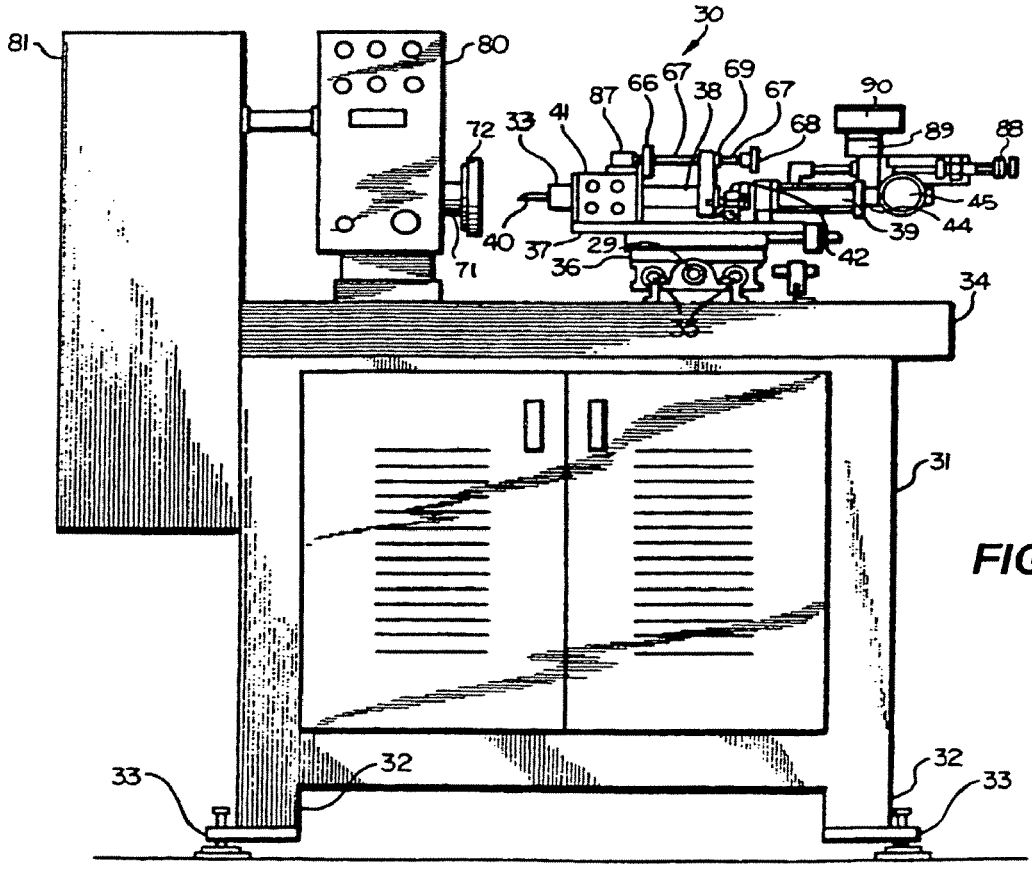
FIG. 3

METHOD FOR MAKING AN ELASTOMERIC SEALING DEVICE

The priority under 35 U.S.C. §120 as a continuation-in-part application is claimed of International Patent Application No. PCT/US2007/073160, filed Jul. 10, 2007 which claims the benefit under 35 U.S.C. §119(e) of U.S. Provisional Patent Application Ser. No. 60/819,857, filed Jul. 10, 2006, and the disclosures thereof are incorporated herein by reference.

FIELD OF INVENTION

This invention relates to improved methods of producing sealing devices for sealing electrical cables or other items; and, more particularly, to an improved process and product for providing an improved elastomeric sealing sleeve for use in sealing various penetrating conduits, electrical, fiber optic, or other communication cables in a housing such as in a free breathing aerial terminal, hermetically sealed splice enclosures, or through penetration sealing devices in which the sleeve has a plurality of removable concentric sizing rings. Seal assemblies comprising the sealing sleeves of the invention serve to protect housing components from adverse environmental conditions while at the same time maintaining or jacketing the sealed cable(s) in the desired position free of damaging the cable splice either in initial installation, expansion, repair or normal maintenance procedures.

BACKGROUND OF THE INVENTION

Communication cables, such as electrical and fiber optic cables, are often spliced or stored in duct work or an enclosure for later expansion of a network. The cables are normally jacketed in a sealed enclosure that has to be invaded in order to make the desired splice connection. Problems sometimes exist due to a poorly sealed cable assembly. Various designs have been employed to minimize adverse cable splice exposure.

One problem that sometimes occurs is that due to deterioration of various materials, or for expansion of a cable assembly after a period of time, a seal assembly may have to be repaired, or re-penetrated in the field. Unfortunately, various terminals, enclosures, and seal assemblies presently available are not particularly installer friendly. In some instances, an undesired manual operation has to be performed in the field, i.e., removing and discarding unpenetrable splice enclosure port plugs, or drilling a cable through bore in the seal assembly. Further, it has been found that when cables have been installed in the penetration ports or drilled bore holes so that the seal assembly can complete a cable splice housing, the seal is not entirely satisfactory. A room temperature vulcanizing (RTV) material, mastic, tape or sealant has to be employed in the field at the location of the cable and corresponding port or bore to provide the requisite sealing and protect the cable splice or through penetration sealing devices from environmental exposure, i.e. dust, dirt, vermin, chemicals, moisture, fire and toxic byproducts of combustion.

Further, it has been found that some seal assemblies are pre-manufactured to custom fit a particular size cable. The difficulty experienced with this type seal arrangement is that a relatively large inventory of seal assemblies is required for use with different size cables. What is desired is a single seal assembly which can accommodate different size cables.

Additionally, it has been found that, in some instances, when a particular seal assembly is installed at a job site, the components of the seal assembly, when crafted or tightened during installation, do not always provide for uniform sealing throughout the seal assembly. Rather, upon installation, the seal components generate uneven forces that sometimes produce an undesired seal assembly.

What is desired is a seal assembly which can be utilized with a housing, conduit, or cable splice assembly in which the seal assembly accommodates various size cables free of having to initially discard unpenetrable plugs and secondarily use excess inventory of craft sensitive materials, or perform a drilling operation in the seal assembly, either at the factory or in the field.

Further, it is desired to have a seal assembly which, when installed, provides the desired sealing characteristics in that the penetrating conduits or cables stored, spliced or protected by means of a cable housing or through penetration sealing device, are protected from adverse environmental exposures, i.e., dust, vermin, dirt, chemicals, moisture, fire and toxic byproducts of combustion.

Moreover, it is desired to have a seal assembly that is relatively installer friendly in that the seal assembly will permit various sized penetrating conduits or cables to be relatively readily utilized with the sealing assembly. Further, it is desired that the seal assembly be relatively easily assembled as a barrier seal and disassembled easily to accommodate cable penetration. Moreover, the seal assembly must be relatively easy to assemble or disassemble during cable installation, closure maintenance or repair and network expansion procedures.

The present invention relates to an improvement over the disclosure of co-owned Mitchell, U.S. Pat. No. 5,048,382, the disclosure of which is hereby incorporated by reference. This patent teaches methods for providing elastomeric sealing sleeves in which concentric rings are cut cleanly into the sleeve for substantially the entire thickness of the sleeve. Each ring is cut entirely about its circumference without unwanted serrations occurring in the sleeve. Briefly, in the process of the present invention, a molded, extruded or die-cut elastomeric sleeve having an appropriate size and shape is positioned on a chuck means whereby one side or face of the sleeve is maintained by a vacuum means against the outer face of the chuck.

A cutting machine, which holds a cutting knife, is indexed to align the knife relative to a selected position on the remaining side of the sleeve. The chuck and sleeve then are rotated at a desired speed whereby the sleeve is spun about a longitudinal axis. The cutting machine is actuated whereby the knife enters one side of the rotating sleeve and commences to cut a concentric slit into the sleeve.

As the knife progressively cuts into the sleeve, elastomeric sleeve material located contiguous to the outboard side of the knife separates slightly from the sleeve material located adjacent the inboard side of the cutting knife. Without being bound by a particular theory, it is believed that the separation of sleeve material in the vicinity of the knife blade is caused by the centrifugal force acting on the rotating sleeve. In other words, a small pocket is formed in the sleeve at least at the location of the cutting knife, the effect of which is to allow the knife blade to penetrate relatively cleanly and easily into the elastomeric sleeve such that a concentric ring is cut cleanly into the sleeve.

The cutting machine then is actuated whereby the cutting knife is retracted from the sleeve and indexed radially outward to a second location where a second concentric slit is cut into the face of the rotating sleeve. The process is repeated until the desired numbers of concentric slits are cut into the sleeve.

While cutting operations are performed on the sleeve, the sleeve and cutting tool are flushed extensively with a cooling lubricant to preclude excessive heat build up occurring in the sleeve and knife, the attendant disadvantage being that heat generated in the cutting operation tends to reseal adjacent sections of the sleeve which have been cut.

It is believed that the rotating sleeve generates a centrifugal force which serves to separate adjacent portions of the sleeve at least in the area where the knife is cutting the elastomeric sleeve. This material separation allows the knife blade to make a clean ring cut into the elastomeric material obviating serrated ring problems which existed in prior art practices, predating the Mitchell '382 patent. No talc-like material is required such that, upon completion of a cutting operation, an improved elastomeric sealing sleeve is provided having the desired number of concentric rings disposed therein. Moreover, one side or face of the sleeve is free of any cuts or nicks.

Despite the success of the method of the Mitchell patent for producing sealing devices there remain certain limitations in the Mitchell method as the needs of the telecommunications, utilities, construction and fabrication industries have matured. Specifically, the Mitchell method is particularly useful when the sealing devices having concentric rings are greater than 3 inches in diameter. As a function of their design, these large elastomers have a correspondingly large surface area which is beneficial when a vacuum is used to hold the elastomer against a rotating chuck. In this method, the proportionate surface area of the large elastomer created a requisite cavity to work with the vacuum, and the device could be successfully held against a rotating chuck in order that the procedures of U.S. Pat. No. 5,048,382 could be utilized.

One shortcoming of the basic method of the Mitchell patent is that the concentric rings are relatively thick, and while the end sealing washers were successfully utilized to limit exposure to weather in the original splice case products of GATM, U.S. Pat. No. 4,694,118, the thickness of this ring processing did not offer a pressure-tight, or hermetic seal around a penetrating cable. In this sense, the GATM splice case and its end seals are classified as free-breathing.

More recently there exists demand for a re-penetrable, elastomeric sealing device for the smaller cable ports of pressurized, and water proof electrical and telecommunication splicing enclosures. Due to the high bandwidth requirements of advanced copper connectivity solutions, cable broadband, fiber optic, and electrical transmission and distribution sealing enclosures, an effective and reliable pressurized enclosure(s) and/or sealing assemblies are necessary in order to protect the spliced/fused junctions of the conductors. Similar needs also exist with respect to duct-work, cabinets, structural bulkheads, through penetration sealing devices and the like.

Existing pressure-tight/watertight sealing enclosures have considerable mechanical strength properties within their design that they can provide a hermetic seal against the environment. However, an inherent weakness of these type of enclosures becomes apparent when it comes time to effectively seal one, and sometimes multiple penetrating conduit (s) or cable(s) of unknown manufacture and supply, thereby having an unknown outer jacket circumference. Moreover, it will sometimes be desired that several different outer jacket circumferences will penetrate an individual, multiple port enclosure or sealing device.

There exist several labor intensive, and craft sensitive means to seal single or multiple axes into a penetration port. However, these are secondary penetration methods which typically do not coincide with a means to initially seal off any unused penetration ports and provide for future expansion without wasteful disposal of inadequate port plugs. Several of the methods used to effectuate a penetration seal also require a considerable amount of time and material to wrap a continuous ply around a single or multiple penetrating axis. These methods enlarge the cable's nominal outer jacket diameter to an increased profile which will effectively engage within the inner molded profile of the corresponding cable port. These methods further require the inherent mechanical properties of the splice case, or sealing product to create an effective, pressure tight/water tight seal.

Sometimes known as "mastic-wrap" the continuous ply technique does not readily provide for an effective means to seal the interstice space between multiple cables. Multiple cable penetrations through a singular port is a desirable means to maximize the utility of existing splice protection enclosures and new deployment of various manufacturer's equipment in order to increase their serviceable deployment and provide maximum transmitting potential through a vast network of existing and expanded capitalized infrastructure.

There remains a desire in the art to provide original barrier seals which are designed to mechanically interface within the cable access/penetration port(s) profile(s) of various sized splice enclosures and through penetration devices. In the installed scenario, there remains a desire for pre-molded seals or grommets to achieve the same final product stage as the above referenced Mastic-Wrap in regards to its mechanical interface and seal engagement with the seal assembly. It is desired for such seal assemblies to first be an effective and un-penetrated barrier; for the seals to be capable of being field modified with little or no tools so as to minimize expensive craft sensitive labor. It is further desired to eliminate waste created by removing and discarding the heretofore undesirable and un-penetrable port plugs. Further, it is desired that the seals be pre-engineered to accommodate single, as well as multiple axes of penetration. It is thereby desired to provide improved methods for producing smaller sizes of seals having single as well as multiple axes of penetration. In particular, improved methods for producing seals having concentric sizing rings which seals are less than 3 inches in diameter are desired.

It is also the case that with smaller diameter cables, such as fiber optic cables that finer gradations of ring thicknesses are needed than is the case with larger diameter copper cables. This is because the smaller circumferential surfaces of such smaller cables have reduced sealing surfaces and thus require a closer "fit" between the sealing rings and the cable. The method for cutting the sealing blanks therefore must be more precise in order to meet the closer tolerances demanded by the use of smaller diameter cables.

While vacuum fixturing and the rotation of small elastomeric shapes is possible, any attempt to cut into the rotating device to process a plurality of rings according to the methods of the '382 patent will cause it to disengage from the revolving fixture. Disengagement from the rotating chuck therefore not only makes ring-cut processing impossible, but also is a serious safety hazard for either a machine operator or an equipment hazard in that the manufacturing process equipment will have uncontrolled exposure to loose, flying parts. Accordingly, there remains a need in the art for improved methods for producing small seals having one or more series of removable concentric sizing rings.

SUMMARY OF THE INVENTION

The present invention provides methods of fabricating seals with a plurality of removable concentric sizing rings by providing a thin elastomeric extended flange to the seal blank and securing the seal blank for machining to a vacuum chuck by means of the thin extended flange.

Specifically, in a process of producing a plurality of knife cut concentric ring sections into a device having first and second faces and formed of a non metallic pliant material, the ring sections being concentric with an axis of the device and extending parallel with the axis, the process comprising the steps of: a. mounting the first face of the device in a rotatable chuck means having a rotatable axis by means of a vacuum seal between the first device face and the chuck; b. rotating the device about the axis on the chuck means; c. positioning a knife means substantially perpendicular to the second face of the device at a first radial distance from the axis; d. moving the knife means parallel with the axis relative to the device whereby the knife means cuts a slit into the device while the device is rotated, the knife means moving to a position more closely adjacent the first face; e. continually rotating the device while the knife means continues to cut into the device; f. positioning the knife at another radial distance from the axis, and repeating steps d. and e. thereby forming a ring section; g. positioning the knife at another radial distance from the axis and repeating steps d. and e. to form a second ring section; and, h. dismounting the device from the chuck without removing the ring sections from the device; the improvement comprising increasing the size of the first face to create a thin extended flange such that the cross-sectional area of the first face disposed against the chuck is at least 150% and more preferably at least 200% and even more preferably at least 250% of the cross-sectional area of the body of the device. According to one aspect of the invention the cross-sectional area of the body is less than 10 square inches and more preferably less than 5 square inches. Even more preferably the cross-sectional area of the body of the device is less than 3 square inches and still more preferably less than 1 square inch.

The surface of the thin extended flange to be disposed against the vacuum chuck is preferably free of irregularities although according to one preferred aspect of the invention the extended flange has a ridge disposed close to its outer perimeter which is received within a corresponding groove in the vacuum chuck. Thus, the surface of the thin extended flange to be disposed against the vacuum chuck is free of irregularities such that the surface of the flange disposed behind the cross section of the device to be processed with concentric slits is co-planar to the flat surface of the vacuum chuck.

According to another aspect of the invention, the extended flange is less than 20% of the height of the full elastomer and according to still another aspect of the invention the outer edges of the thin extended flange mate with the walls defining a corresponding recess on the vacuum chuck which secure the device against rotation relative to the chuck during working.

The seal device is preferably an elastomeric material and preferably has a durometer in the range of 30-80 (A scale) with a durometer of about 70 (A scale) being preferred.

According to one method, the speed at which the knife moves parallel with the axis and enters the device varies as the knife is spaced further from the first knife position. Practice of the invention can further include the step of slitting the device radially following the cutting of one or more rings into the device.

Because practice of the invention provides improved control in the cutting of concentric ring sets it is possible to more easily provide seals in which a plurality of concentric ring sets, each set having at least one ring, are cut into the device. In addition it is more readily possible to form a plurality of sets of concentric ring sections in which the axis of at least one set, and preferably in which the axis of each set is offset from the axis of the device.

According to practice of the method of the invention, the extended elastomeric base acts as an oscillating damper which flexibly permits the rapid progression, galloping, instability and fluctuation to the molded profile that is created by a sharpened carbide knife penetrating the rotating device. In addition, the increased surface area of the extended base counteracts the drag upon elastomeric profile when knife penetrates. While an extended elastomeric base is generally not required for large seals having diameters greater than three inches its incorporation with smaller seals creates a favorable aspect ratio between the requisite volumetric scale of the desired smaller parts and the available surface area for vacuum fixturing. This aspect ratio must remain favorable enough that an elastomer can stay fixed to a rotating vacuum fixture with a force greater than, and proportional to the torsional drag created by knife penetration which tends to be independent of the diameter of the seal being cut.

It is desired that the extended flange be relatively thin. In particular, it is preferred that the thin extended base, or flange have a thickness that is less than or equal to 20% of the total height of the full elastomeric profile. The thin flange permits lateral axial movement of the elastomeric penetration seal processing area, without breaking or negating the vacuum needed to hold device during repeated knife penetrations. The extended footprint provided by the flange provides a favorable proportional aspect ratio while also acting as a dampening shock absorber for centrifugal deflection.

The use of the flange is particularly advantageous where it is desired to insert multiple cable ports within a single seal. In this manner multiple axes can then also be processed by simply turning a square or rectangular blank at successive, 90° and 180° intervals to create multi-axis penetration patterns. It will be apparent to those of skill that other complementary angles such as by using flanges with three-fold (triangular symmetry), five-fold (pentagonal symmetry), six-fold (hexagonal symmetry) and the like may be used to create various multi-axis penetration patterns.

After the concentric sizing rings have been cut the thin, extended elastomeric flange can be modified via rotational method to trim to a preferred outer diameter (OD) profile that can engage within molded channels, enhancing installation. The thin extended flange can otherwise be die-cut to conform to alternate shapes. The flange can also be completely removed by either method above, leaving just the preferred profile for specific installation technique. The completed elastomeric shapes can then also be deployed within complementary elastomeric glands, or into larger pre-molded or fabricated shapes, designed as complex barriers.

Practice of the invention minimizes the need for an extensive array of the expensive, multi-axis rotational fixtures needed to process similar, large, complex elastomers. Further, practice of the methods of the invention can increase the number of potential cable axes into composite elastomeric shapes. Finally, the ability to fashion small seals avoids the considerable cost of vulcanizing larger elastomers out of pristine elastomeric compounds only to enable secondary cable axis processing upon small cable penetration areas. Not only is this important because of the increased cost of rubber compounds but also because the vulcanization of rubber creates single molecular structures which must be carefully cross-linked with very few or no voids and porosity in order to withstand the aggressive, systematic concentric ring processing performed upon the elastomeric shape. The ability to work small seal blanks thus provide significant advantages.

In addition, large elastomers have great weight and volume. Processing multiple axis (non-centered) seal penetration patterns upon large elastomers creates an eccentrically spinning product, and as a result an off-balance flywheel effect upon the large elastomer must be countered by large volume rotational chucks, and counter-weights.

The invention provides an improved elastomeric sealing sleeve in which the concentric rings are cut cleanly into the sleeve for substantially the entire thickness of the sleeve. Each ring is cut entirely about its circumference without unwanted serrations occurring in the sleeve. According to the method, one or more series of concentric rings can be created in a single seal blank in order that either multiple or a plurality of penetrating elements of the same, or multiple circumference(s) can be passed through the seal.

Briefly, in the process of the present invention, a molded, extruded or die-cut elastomeric sleeve having an appropriate size and shape is positioned on a chuck means whereby one side or face of the sleeve is maintained by a vacuum means against the outer face of the chuck. Because the sleeves processed according to the invention have a small mass, large rotational fixtures are not required. Therefore, additional counterweights are not required due in part to having also utilized a recessed and complementary cavity upon the rotational chuck. In a cross-sectional view, the machined, depressed cavity sits below the original mass of lightweight aluminum so that there is a rotating fixture above the desired maximum knife penetration. A consistent, maximum knife penetration depth contiguous to the opposite face of the elastomer will create a desired, thinner membrane. Along with light mass of small improved seals processed in this manner, the depressed cavity is believed to provide a rotational flywheel which may help to negate the natural precession of the heretofore rotating elastomer that sat upon chuck face plate 72. The face plate 72 further has a continuous groove 74 about its perimeter which accepts a continuous ridge 20 upon the back side of the extended flange 19.

Upon vacuum being applied, the mounting face 17 of sleeve 10 is drawn into full contact with face plate 72 while the thin cross section of the extended flange 19 resiliently deforms. This direct contact allows for consistent knife depth. The distance to the back face of the elastomer can now be controlled with greater accuracy and a thinner membrane section is possible. Without undue deflection of the elastomeric shape, the progressive knife indexing can become smaller, creating appropriate thinner concentric rings. Practice of this aspect of the invention provides the ability to control the membrane thickness (described as approximately 0.040 inch of the opposite side in the '382 patent) and creates an improved membrane thickness of 50% or less of that (approx 0.015 to 0.020 inches) which is required in order to effectively peel ever thinner rings away from the membrane. In general it has been found that membrane thickness should be ⅔ or less the thickness of the concentric ring to accommodate effective concentric sealing rings. The further advantage of the extended flange profile resting within the depressed pocket upon the rotational fixture is then the ability for it to act as an oscillating, flexible base. This base allows the elastomeric processing area to deflect outward of the knife penetration. It is believed that the separation of sleeve material in the vicinity of the knife blade is caused by the centrifugal force acting on the rotating sleeve. In other words, a small pocket is formed in the sleeve at least at the location of the cutting knife, the effect of which is to allow the knife blade to penetrate relatively cleanly and easily into the elastomeric sleeve such that a concentric ring is cut cleanly into the sleeve. The rotating extended flange now becomes a thin, flexible means to firstly maintain an appropriate surface area in contact with the vacuum chuck to counteract the influences of drag and torque created from knife penetration; while secondly, providing a resilient means to cyclically absorb the deflection of the "cutting knife pocket" which is always to the outward or centrifugal side of the knife. At this point, the basic elastic rubber properties of compression, extension, rebound and memory to shape allow the elastomer to flow freely around the knife and thinner rings can be accomplished due to the straighter cuts created within greater control of precession.

According to one aspect of the invention, the largely unrestrained control of the elastomer accomplished by controlled gripping or restraining only the appropriate features of the base will further allow cutting of multiple, offset axes. The use of the extended flange to grip the seal to the chuck along with the smaller size of the seals also makes it possible to cut offset axes without the requirement of any counterweight. This represents a significant improvement over prior methods. The ability of the extended flange to dampen oscillation complements the constant resilient rubber centrifugal effect while enhancing the desired aspect ratio of proportionate surface area vs. the small volume of seal process area. A desired rear mounting face of the elastomer directly in contact with rotating fixture allows for single and multi-axis penetrations without undue precession and therefore excessive taper of concentric rings. Practice of the present method can achieve a largely controllable angle of taper within zero to +/−2 degrees which compares favorably with the analogous but different standard of the Rubber Manufacturers Association (RMA) lathe cut processing which provides for a knife cut deflection of 4 degrees as a precision tolerance. (The RMA precision lathe cut is performed with knife axis penetrating the rubber perpendicular to the axis of rotation. The method of the invention performs ring cutting with the knife axis parallel to the axis of rotation.) That is, the present method substantially plunges a knife into an elastomer in an orientation that is uncomplementary to the angular velocity of the rotating elastomer. The profile of the plunging knife would be potentially trapped within the volume of the elastomer, if not for the extended elastomeric flange that provides a favorable aspect ratio to counteract torque, while also providing rotational cushioning and desired dampening effects.

A cutting machine, which holds a cutting knife, is indexed to align the knife relative to a selected position on the remaining side of the sleeve. The chuck and sleeve then are rotated at a desired speed whereby the sleeve is spun about a longitudinal axis. The cutting machine is actuated whereby the knife enters one side of the rotating sleeve and commences to cut a concentric slit into the sleeve.

As the knife progressively cuts into the sleeve, elastomeric sleeve material located contiguous to the outboard side of the knife separates slightly from the sleeve material located adjacent the inboard side of the cutting knife. Without being bound by a particular theory, it is believed that the separation of sleeve material in the vicinity of the knife blade is caused by the centrifugal force acting on the rotating sleeve. In other words, a small pocket is formed in the sleeve at least at the location of the cutting knife, the effect of which is to allow the knife blade to penetrate relatively cleanly and easily into the elastomeric sleeve such that a concentric slit is cut cleanly into the sleeve.

The cutting machine then is actuated whereby the cutting knife is retracted from the sleeve and indexed radially to a second location where a second concentric slit is cut into the face of the rotating sleeve. Any two adjacent processed slits as such form the boundary of a concentric ring. The process is repeated until the desired number of concentric rings is cut into the sleeve.

While cutting operations are performed on the sleeve, the sleeve and cutting tool are flushed extensively with a cooling lubricant to preclude excessive heat build up occurring in the sleeve and knife, the attendant disadvantage being that heat generated in the cutting operation tends to reseal adjacent sections of the sleeve which have been cut.

It is believed that the rotating sleeve generates a centrifugal force which serves to separate adjacent portions of the sleeve at least in the area where the knife is cutting the elastomeric sleeve. This material separation allows the knife blade to make a clean ring cut into the elastomeric material thereby obviating the serrated ring problem which formerly existed. Upon completion of a cutting operation, an improved elastomeric sealing sleeve is provided having the desired number of concentric rings disposed therein. Moreover, one side or face of the sleeve is free of any cuts or nicks.

Practice of the methods of the invention also provide the ability to produce complementary glands that can otherwise be manufactured of various engineered materials needed for specific applications, i.e., durometer deltas, chemical/environmental exposure, intumescent cable penetration barriers. The complementary glands can be fabricated of material that is either not required to be processed, or unable to be processed with concentric ring patterns. The glands can further receive improved sealing devices made from the current invention.

Further advantages of the invention will become apparent from the following description of the drawings and detailed description of the invention.

DESCRIPTION OF THE DRAWINGS

FIG. 1 shows an elastomeric sleeve made according to the process of the present invention;

FIG. 2 shows a cross-section view taken along lines 2-2 in FIG. 1;

FIG. 3 shows a front view of an indexable cutting machine for carrying out the process of the present invention;

DETAILED DESCRIPTION

Figure 4:
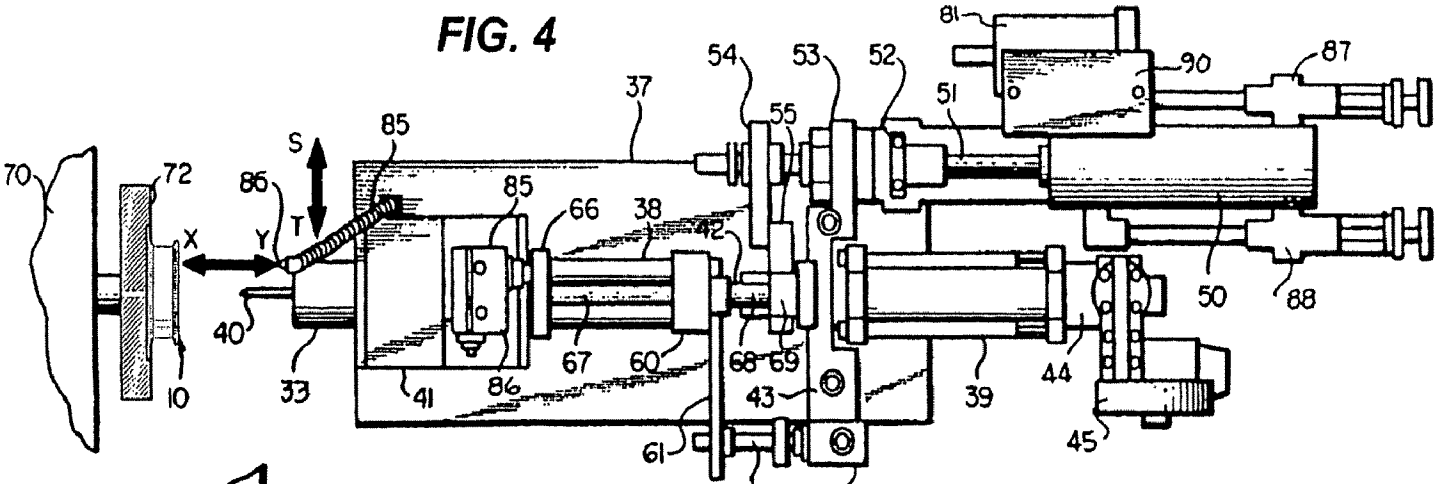
FIG. 4 shows a partial, plan view of the machine of FIG. 3.

According to one aspect of the invention it is noted that ring processing tolerances are heavily influenced by ASME Y14.5.1M, Tolerancing Principles; especially relative to non-rigid parts/free state variation/restraining forces. With full consideration for this ANSI/ASME standard, practice of the present invention provides small diameter (diameters less than 3 inches and more preferably less than 2 inches) seals that are consistently manufactured with 0 to +/−2 degree ring tapers. The tolerance of these ring tapers are well within RMA Precision Tolerances that allow for 4 degrees taper in a "standard" lathe cut product.

An understanding of the physics related to processing the concentric rings is helpful to an understanding of the present invention. The processing of the elastomeric rings is carried out by separating the molecular structure of the blank rather than a "cutting" technique such as when wood is sawed where a "kerf" is created that could otherwise be used as a tracking method to keep penetration lines on zero degree taper. As a consequence, knife penetration is therefore heavily influenced by aspects of rotational physics such as precession and torque.

The circular path created by the knife penetrating into the elastomer intersects the coupling "midline" upon the revolving elastomer. The "midline" is perpendicular to the angular acceleration vector(s), and intersects the rotational axis. Knife penetration into the elastomer anywhere along this circular path creates drag upon the rotating elastomer. Anytime the drag creates unbalanced moments relative to inertia, this drag results in torque. Torque can then adversely increase precession which is the tendency for the elastomer's turning axis to shift in order to stay perpendicular to the axis of angular momentum. The precession of the elastomeric seal blank causes taper to knife penetration path, thereby creating a conical (negative angle) cutting path. While the earlier processing technique generally cut by progressing from the inner diameter (ID) to the outer diameter (OD), precession is further limited by changing the processing technique to proceed from the outer diameter (OD) to the inner diameter (ID) as well as by reducing the weight, mass and volume of the elastomeric blank.

The aforementioned unbalanced moments which affect the torque characteristics and precession can be minimized by extending the fixturing footprint which, in turn, counteracts the rotating elastomer's tendency to grip the knife upon penetration. Thus, another variation performs ring processing first from the outer diameter of a smaller blank thinning out the cross section of a revolving ring. Rubber elongation properties will allow the outer wall (ring section) to stretch outside of the knife, thereby lessening the elastomer's tendency to trap the knife profile. Accordingly, sequential O.D. to I.D. knife penetrations systematically "carve" more material away from the core that is revolving around an axis. Ring sections are flung outside of knife, as distinguished from cutting from the inner diameter first to the outer diameter where the larger, outer rotating profile is then reduced by sequential passes from the inside, each pass reducing the encompassing profile of the elastomer, and creating different torque/precession influences upon rotating elastomer. When cutting from the inner diameter toward the outer diameter the elastomer cannot initially expand centrifugally as the knife substantially reaches the base of the blank. The outer perimeter of the elastomer therefore restricts knife penetration into the elastomer, which in turn counteracts the knife's straight line penetration. As a consequence, the penetrating axis of the knife is turned inward slightly, further influencing the precession of the elastomer's spinning axis.

According to one aspect of the invention, the extended mounting face of the elastomeric blank is drawn directly upon the fixturing surface, thus obviating any disproportionate stretching to back surface, or deflection of entire elastomer. This represents an improvement over prior art methods in which the prevailing majority of the surface area of the mounting face(s) of a large elastomers is held by vacuum above the fixturing surface, literally above a concave void that has been rarified below atmospheric pressure. According to these prior methods when the knife penetrated the elastomer, the rubber deflected in direct relation to the indexed point of knife penetration, thereby stretching the bottom surface. This could result in inconsistent depth of the back-side membrane.

According to practice of the present invention it is preferred that the membrane must be typically ⅔ or less than the thickness of the preferred ring thickness so that the concentric rings can be torn cleanly from the membrane to effect a desired seal.

Elastomeric seals may be fabricated from any suitable natural or synthetic material which has the required characteristics of being generally elastic and resilient and sealing about the various surrounding and/or penetrating components when squeezed or compressed. One material that can be utilized is ethylene propylene diene monomer (EPDM) having a 30 to 80 Shore A durometer and preferably a durometer of about 60 to 75 Shore A. Other elastomeric materials could be employed that are apparent to a person of ordinary skill in the art depending upon a particular application.

Referring to the drawings, there is shown in FIG. 1 a sealing sleeve 10 formed of a pliant material. Sleeve 10 has a circular shape having flanges 11, 19 extending outwardly from each side of the sleeve to form a recess 14 about the circumference of the circular sleeve. The sleeve further includes a plurality of concentric, radially spaced ring sections 15 each of which is cut into the sleeve 10 for substantially the entire sleeve thickness and specifically from side 16 contiguous to side 17 as seen in FIG. 2. By removing one or more ring sections, a desired size of aperture may be achieved in the sleeve such that a single sealing sleeve 10 is capable of enclosing telecommunications or utility cables, or any other penetrating conduits having different circumferences. A radial slit (not shown) can be formed extending from proximate a center axis of processed rings 15 to the perimeter of the elastomeric sleeve 10. On side 17 is disposed a thin extended flange 19 which in this case is square shaped and extends beyond the periphery of circular flange 11. (After cutting of rings 15, flange 19 can be trimmed away to result in a circular flange complementary to flange 11.) The thin flange 19 preferably comprises a continuous ridge 20 around the periphery of its base.

In use, an installer first sizes the cable upon which sleeve 10 is to be sealed. Then, the requisite number of ring sections 15 progressing from the penetration axis are removed from the sleeve to form the desired aperture. Spreading the sleeve along a radial slit (not shown) the sleeve can be slipped onto a cable.

Sleeve 10 generally is formed from a material that is sufficiently pliant such that sleeve 10 can be compressed and sealed as required. One material that has been utilized is an elastomeric material made from EPDM having a durometer, when vulcanized, of about 60 to 75 (A scale). The cable penetration processing area of the sleeve is fabricated to have a shape that will fit into a desired seal retaining area once the extended flange is removed or modified.

Following a conventional manufacturing operation to produce unprocessed elastomeric sleeves, concentric rings are processed into the sleeve by cutting machine 30 as seen in FIG. 3, or other suitable apparatus.

Cutting machine 30 includes frame 31 having legs 32 connected to the floor by adjustable fastening means 33.

Base 34 is disposed on top of frame 31, the base, in turn, being disposed in a trough, not shown, which receives lubricating fluid following lubrication of a sleeve during a cutting operation. The lubricating fluid falls onto the base where it spills over into a collecting trough where it is collected and recirculated.

Disposed on base 34 is a pair of parallel rails 35. Carriage 36 moves on rails 35, the carriage being adapted to move in an S-T direction as indicated by the arrow in FIG. 4 by means of a ball screw and ball nut illustrated at 29.

Plate 37 is mounted on carriage 36. A reciprocating bar 38 is disposed on plate 37 for axial movement in the X-Y direction. At one end of bar 38 is a cutting knife chuck 33 which holds a cutting knife 40. Bar 38 is mounted for movement within a bar support member 41 which, in turn, is fastened to plate 37. Support member 41 surrounds bar 38 on all sides and permits the bar to slidably move within the support. An air or other fluid cylinder 39 having a movable piston 42, which is connected to the remaining end of bar 38, is seated in a first cylinder frame 43 mounted on plate 37. An air valve assembly 44 and an electrical junction box 45, which contains the electrical controls for actuating air valve assembly 44, serve to admit air into air cylinder 39. Upon actuation of cylinder 39 by valve assembly means 44, piston 42 is actuated to move block 38, chuck 33 and knife 40 in the X or Y direction shown in FIG. 4.

A second hydraulic cylinder assembly 50 having a piston 51 is disposed on plate 37. Piston 51 passes through a suitable bearing assembly 52 which is attached to a bearing frame 53. Frame 53 is mounted on plate 37. Needle valves 87, 88, each of which permits oil to flow into the cylinder at a predetermined rate, are connected to cylinder assembly 50 to allow oil to flow into cylinder 50. Reservoir 89 contains a balance cylinder which, upon movement of the cylinder within the reservoir, directs oil to one of the needle valves 87, 88. An electrical junction box 90 includes the electrical connections for controlling the flow of oil from reservoir 89 to needle valves 87, 88 and cylinder assembly 50.

The outboard end of piston 51 is connected to a stop arm 54. Movement of piston 51 permits movement of stop arm 54. Stop arm 54 extends radially outward from piston 51 toward piston arm 42. A second stop arm 55 is connected to piston 42 and is adapted to contact arm 54 when machine 30 is in operation. Hydraulic cylinder 50 is actuated in tandem with air cylinder 39 such that piston 51 will restrict the speed of travel of piston 42 with the result being that, upon actuation, stop arm 54 contacts stop arm 55. Thus, hydraulic cylinder assembly 50 regulates the speed of movement of piston 42 and bar 38 whereby the speed with which knife 40 enters elastomeric sleeve 10 is controlled. A hydraulic system comprising cylinder assembly 50, piston 51 and needle valves 87, 88, reservoir assembly 89 and box 90, which is satisfactory for this application, is sold under the trade name of Hydrocheck by Schroeder Bellows Company, Akron, Ohio, catalog number Baker 171-21012.

Bracket 60 is fixedly mounted on movable bar 38 and arm 61 extends outward from the bracket. Finger 62, which is parallel to the longitudinal axis of bar 38, is fixed by any suitable means to the outboard end of arm 61. Finger 62 serves to contact a switch member 63 and stops the bar 38 and piston 42 as the bar moves in the "Y" direction shown in FIG. 4. Actuation of the switch member also provides information to a programmable controller or other suitable means to index carriage 36 to a new position on rails 35.

Piston stop 66 is mounted onto the side of fixed bar support member 41. A stop screw 67 having an adjusting head 68 is threaded into bracket 60. Nut 69 serves to lock screw 67 into position relative to bracket 60. A micro switch device 92 contacts stop 66 such that when stop screw contacts stop 66, micro switch 92 directs a programmer controller, not shown, to actuate cylinder 39 whereby knife 40 is withdrawn from sleeve 10 following completion of a ring cutting operation.

A vacuum pump assembly 70, which includes a detachable chuck means 71, is mounted on base 34. Chuck means 71 includes a face plate 72 having one or more perforations 73.

Figure 5:
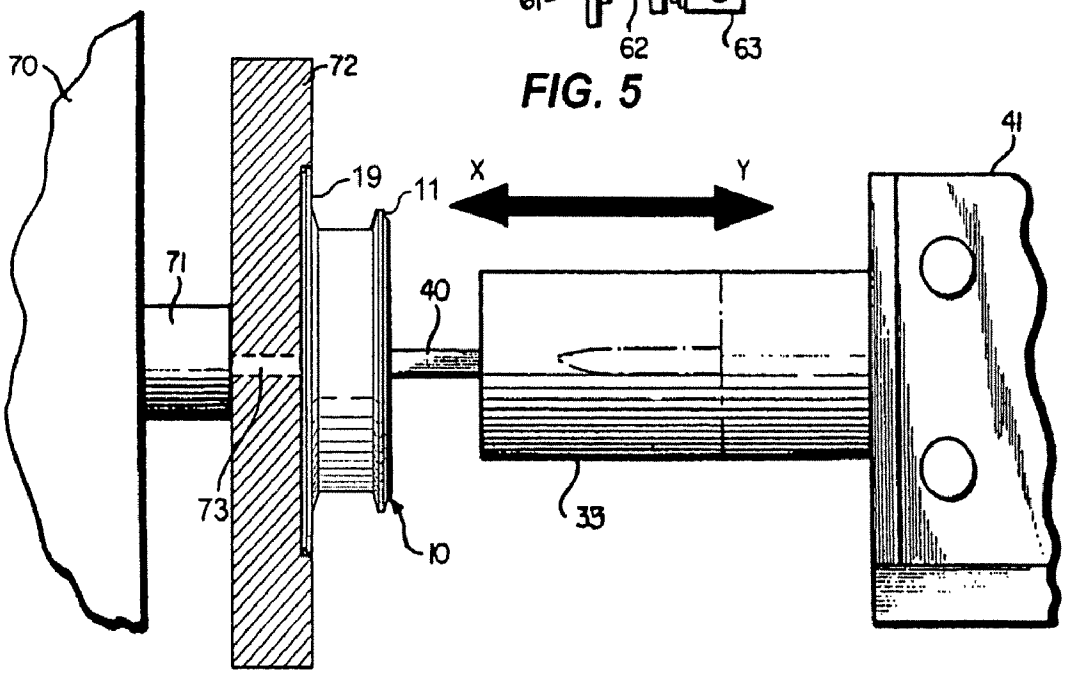
FIG. 5 shows a fragmentary, plan view of a knife cutting a concentric slit into an elastomeric sleeve of the present invention.
Figure 7:
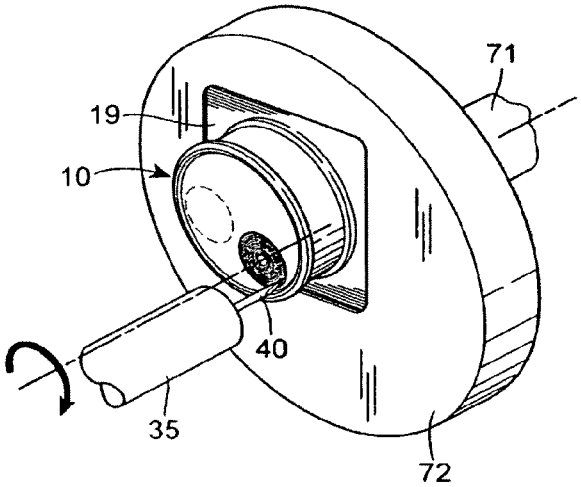
FIG. 7 shows a fragmentary, perspective view of a knife cutting two sets of concentric rings into an elastomeric sleeve disposed on a vacuum chuck means.

Upon actuation of the vacuum pump, a vacuum is pulled on plate 72 at the location of perforation 73 sufficient to hold sleeve 10 onto the chuck 71 as shown, for example, in FIGS. 5 and 7.

An electrical control panel 80 is disposed adjacent the vacuum pump assembly and a switchboard assembly panel 81 for housing suitable and conventional electrical controls for actuating conventional drive motors and the like is positioned at one end of base 34. Drive means include motors or other suitable means for rotating chuck means 71 and transporting carriage 36 on rails 35.

A hose 94 having a nozzle 96 is shown in FIG. 4. Hose 94 leads to a lubricating pump assembly (not shown).

Operation

Figure 8A:
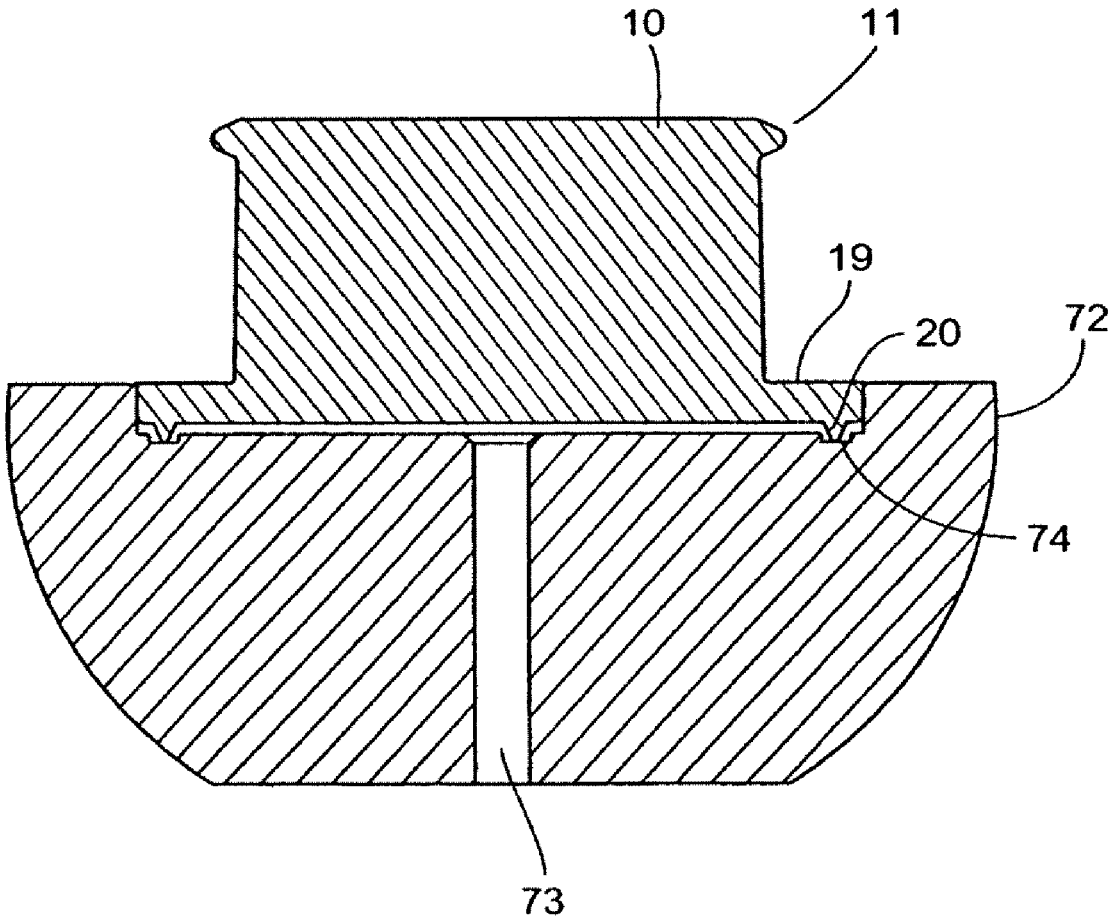
FIGS. 8*a* and 8*b* show a cross-section of the seal 10 disposed within the face plate 72 before (8*a*) and after (8*b*) the vacuum is drawn to secure the seal onto the plate, and, FIG. 9 shows an elastomeric sleeve of the present invention having three sets of concentric rings disposed therein.
Figure 8B:
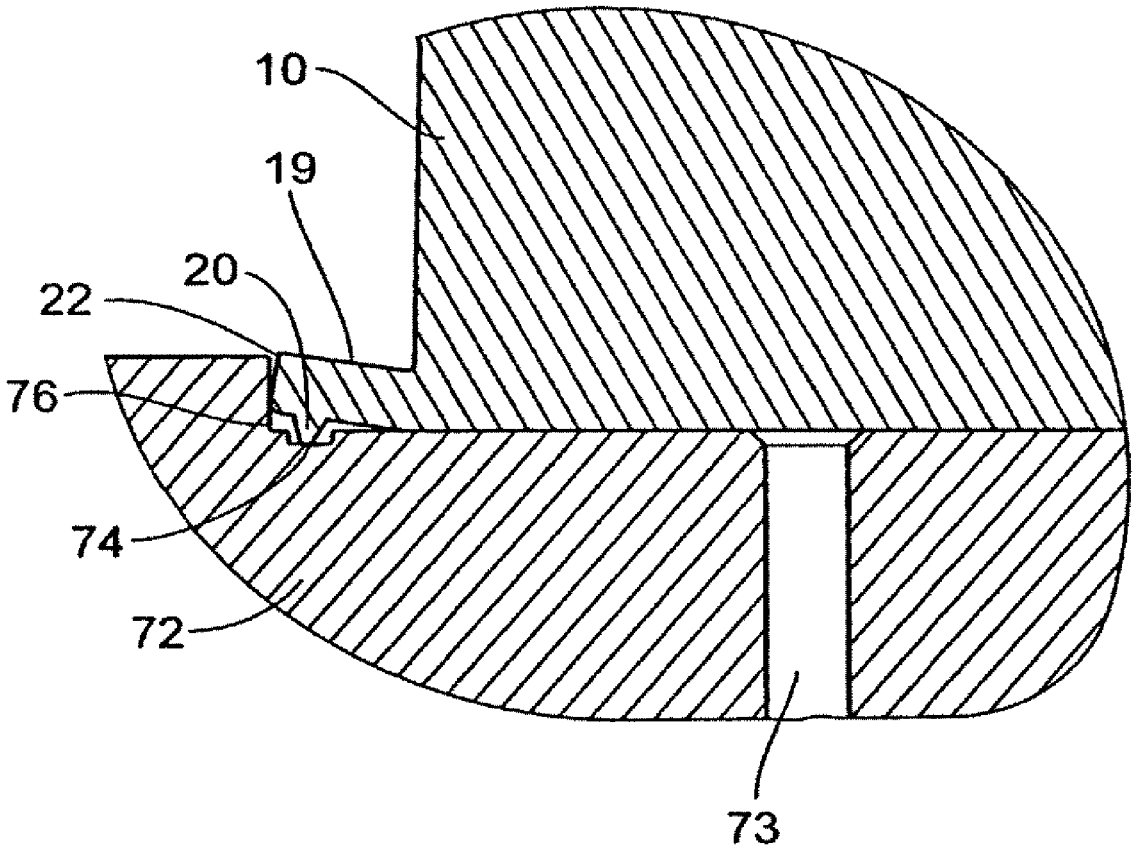

In operation, a vacuum is pulled on sleeve chuck 71, whereby face 17 of sleeve 10 is positioned and maintained on chuck face plate 72. The sleeve 10 is disposed so that the ridge 20 on flange 19 rests within a continuous perimeter groove 74 within the face plate 72. (See FIG. 8*a*) Preferably, a vacuum of about 20 inches Hg is required to hold an elastomeric sleeve onto chuck face 72. Application of the vacuum draws the mounting face 17 of sleeve 10 into full contact with face plate 72 while the thin cross section of the extended flange 19 resiliently deforms and ridge 20 pivots within the perimeter groove 74 maintaining the vacuum seal. A secondary seal is also formed between the outer edge of the flange 22 and the inner edge of the chuck face 76. Once sleeve 10 is installed, chuck 71 is rotated in a clock-wise direction as illustrated in FIG. 7. The speed of rotation for an elastomeric sleeve having a durometer of 60 to 70 (A scale), 1.375 inches in diameter and 0.750 inch thick is 2200 RPM. It is appreciated that different speeds of rotation will be required for different size and shape sleeves; however, the appropriate speed can be ascertained relatively easily by experimentation. "Smoother" use of high torque motors, allows greater flexibility of rpm experimentation as wider range of elastomeric durometers, and material physical properties can now be used. One benefit of processing the smaller size elastomers with the extended elastomeric base footprint is the aspect ratio which offsets drag. It also results in the ability to use efficient, higher torque step motors to rotate the vacuum fixtures. The use of light-weight, high torque motors allows for quicker and more accurate starting and stopping versus low-torque motors used previously to spin larger, heavier elastomers. The use of such larger elastomers on low torque motors require longer startup times until operational speed is met as well as longer cycle-down times to stopping.

Machine 30 is actuated whereby cylinder assemblies 39 and 50 are activated. Bar 38 and knife 40 move in a direction perpendicular to sleeve face 16, whereby knife 40 cuts into rotating sleeve 10 as illustrated in FIGS. 5-7.

The knife blade has a slightly arcuate or convex surface 40' and slightly concave surface 40". One knife blade satisfactory for this application is made from a C-2 carbide material designated as Stellite. Knife blades 40 can be replaced as the blade edges become dull over a period of time. It is important that the knife have relatively sharp cutting edges during the course of a sleeve cutting operation. As the knife cuts into the sleeve, to form a slit as shown, for example, in FIGS. 2 and 6 the elastomeric sleeve material located contiguous to the outboard side 40' of knife 40 pulls outwardly away from the knife blade due to the centrifugal force generated by the rotating sleeve. The knife continues to penetrate into the sleeve until piston stop 66 is contacted by adjustable screw 67. Typically, the cut commences at one face 16 and continues through the sleeve to about 0.015-0.020 inches from the opposite face 17. Knife 40 then is withdrawn, the knife moving in the Y direction until finger 62 contacts switch member 63 at which point knife 40 is completely withdrawn from sleeve 10. Carriage 36 is indexed along rails 35 to the location of another ring. The cutting process is repeated until the desired number of slit rings are cut into the sleeve thereby forming a plurality of ring sections 15 as seen, for example, in FIGS. 2 and 6.

The knife speed for a sleeve 1.375 inches in diameter and 0.750 inch thick as defined above is 1.00 inches/second for ring cuts made into the sleeve up to cuts of about 2.75 inches diameter.

Figure 6:
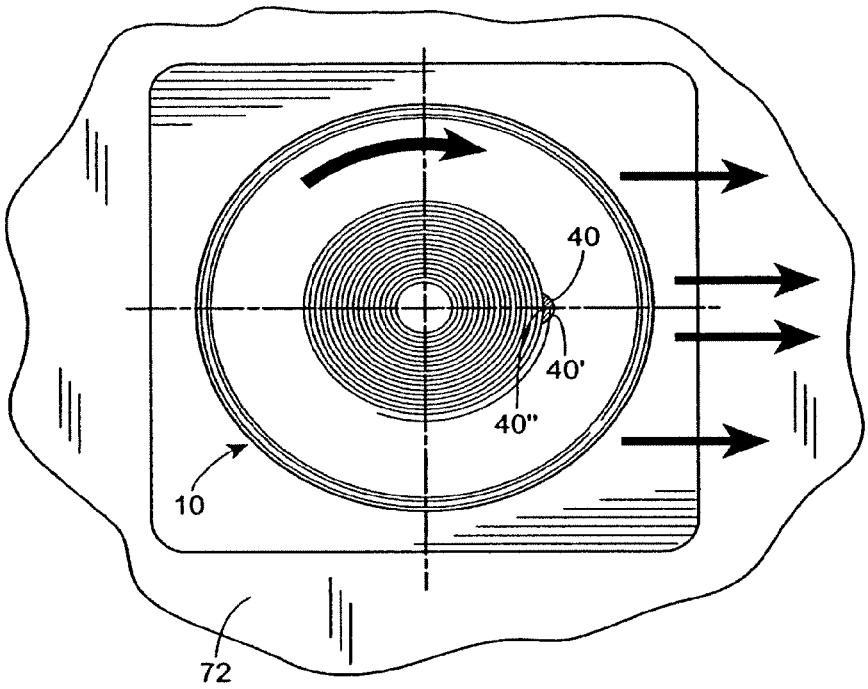
FIG. 6 shows a fragmentary, elevation view of a knife disposed in a concentric slit being cut into an elastomeric sleeve.

FIG. 6 illustrates a sleeve having a set of concentric rings which form ring sections 15 extending radially outward from the center of the sleeve. While this figure illustrates the cutting of rings progressing from the inner toward the outer diameter of the sleeve it will be appreciated that the rings can also be cut from the outer diameter toward the inner diameter of the sleeve. Moreover, it is believed that such cutting from the outer diameter toward the inner diameter may be the preferred means of cutting rings in smaller seals according to the invention. FIG. 7 shows a sleeve positioned on face 72 of vacuum chuck 71 whereby two sets of concentric rings 15 are cut into sleeve 10. When cutting two or more sets of rings, sleeve 10 is offset from the center of vacuum chuck 71. While counterweights are required in the practice of prior art methods cutting large seals they are not so required in practice of the present method.

Figure 9:
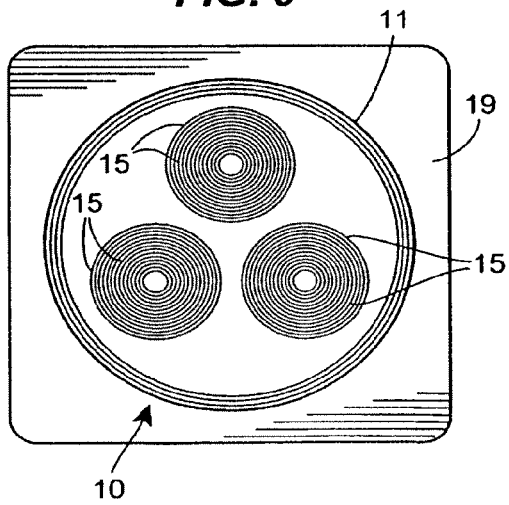

FIG. 9 shows a further illustration of a sleeve 10 having three sets of concentric rings.

In the course of a cutting operation, a liquid lubricant such as a silicone emulsion sold by Dow Corning Corporation, Midland, Mich., catalog number DC-347, is flushed freely onto knife 40 and sleeve 10 cooling them and precluding the sleeve material from resealing after a cutting operation.

It is theorized that by generating a suitable centrifugal force during a ring processing operation, the elastomeric material on the outboard side 40' of knife 40 is pulled away or directed outwardly sufficiently such that the knife can enter a sleeve and travel in the X direction where it makes a relatively clean cut.

It has been found that as the concentric cuts progress outwardly toward the periphery of the sleeve, the sleeve material tends to separate too quickly during a cutting operation. As a result, the sleeve material tends to tear too much material such that a proper cut is not made. As discussed above, it has been found that by reducing the speed of penetration of knife 40 into sleeve 10 during the course of cutting the larger diameter rings, the desired cut can be made. The proper speed for a particular cut can be determined by experimentation. Further experimentation also provides that when the concentric slit cutting progresses inwardly, that is from Outer Diameter OD to Inner Diameter ID, the resultant concentric rings are favorably straighter and exhibit less natural precession.

Rotating the vacuum held elastomeric sleeve material while the sleeve is cut and flushed, permits a sealing sleeve to be made which provides desired sets of concentric rings in which each ring is relatively cleanly cut. The depth of cut also can now be controlled to a greater degree. In addition to the cuts not extending throughout the entire sleeve, the level of knife penetration now has a more consistent depth, and the remaining membrane relative to the face contiguous to the vacuum fixture is now thinner.

It is important that a pliable material be used for the sleeve device. A molded, extruded or die-cut elastomeric sleeve or device having a durometer in the range of about 35-75 (A scale) could be used, however, a durometer of about 55-65, and specifically 60 (A scale), is preferred. Smaller elastomers also permit harder durometers of 70 (A Scale). The thinner ring sections now possible according to the invention give the completed product a more relaxed and pliable characteristic.

It is appreciated that devices made in accordance with the process of the present invention can be used in a variety of applications such as for grommets, plugs, seals or washers in the aircraft and aerospace industry. Similarly, electrical and water transmission seals, plugs or grommets could be made in accordance with the present invention. Plugs, seals or grommets could also be used in the oil and gas fields or shipbuilding plugs, grommets or washers could be made. It is also envisioned that devices such as seals, plugs, washers or grommets would be made for use in the biomedical industry where parts, often fabricated from a silicone material, are placed in the body.

Further, while the sleeve device illustrated in the drawings has been round, it is appreciated that it would be expedient to a person of ordinary skill in the art to use the process disclosed and claimed herein with devices having different desired sizes and shapes such as square, triangular or rectangular, as well as round.

What is claimed is:

1. In a process of producing a plurality of knife cut concentric ring sections into a device having first and second faces and formed of a non metallic pliant material, said ring sections being concentric with an axis of said device and extending parallel with said axis, said process comprising the steps of:

a. mounting said first face of said device in a rotatable chuck means having a rotatable axis by means of a vacuum seal between said first device face and said chuck;

b. rotating said device about said axis on said chuck means;

c. positioning a knife means substantially perpendicular to the second face of said device at a first radial distance from said axis;

d. moving said knife means parallel with said axis relative to said device whereby said knife means cuts a slit ring into said device while said device is rotated, said knife means moving to a position more closely adjacent said first face;

e. continually rotating said device while said knife means continues to cut into said device;

f. positioning said knife at another radial distance from said axis, and repeating steps d. and e. thereby forming a ring section;

g. positioning said knife at another radial distance from said axis and repeating steps d. and e. to form a second ring section; and, h. dismounting said device from said chuck without removing said ring sections from said device;

the improvement comprising increasing the size of said first face to create a thin extended elastomeric mounting flange such that the cross-sectional area of the first face disposed against said chuck is at least 150% of the cross-sectional area of the body of said device and further wherein the thin flange to be disposed against the vacuum chuck has a ridge disposed close to its outer perimeter which is received within a corresponding groove in the vacuum chuck.

2. In a process of producing a plurality of knife cut concentric ring sections into a device having first and second faces and formed of a non metallic pliant material, said ring sections being concentric with an axis of said device and extending parallel with said axis, said process comprising the steps of:

a. mounting said first face of said device in a rotatable chuck means having a rotatable axis by means of a vacuum seal between said first device face and said chuck;

b. rotating said device about said axis on said chuck means;

c. positioning a knife means substantially perpendicular to the second face of said device at a first radial distance from said axis;

d. moving said knife means parallel with said axis relative to said device whereby said knife means cuts a slit ring into said device while said device is rotated, said knife means moving to a position more closely adjacent said first face;

e. continually rotating said device while said knife means continues to cut into said device;

f. positioning said knife at another radial distance from said axis, and repeating steps d. and e. thereby forming a ring section;

g. positioning said knife at another radial distance from said axis and repeating steps d. and e. to form a second ring section; and, h. dismounting said device from said chuck without removing said ring sections from said device;

the improvement comprising increasing the size of said first face to create a thin extended elastomeric mounting flange such that the cross-sectional area of the first face disposed against said chuck is at least 150% of the cross-sectional area of the body of said device and further wherein outer edges of the thin flange mate with the walls defining a corresponding recess on the vacuum chuck which secure the device against rotation relative to the chuck during working.

3. In a process for producing at least one knife cut concentric ring section in an elastomeric sleeve formed of a pliant non metallic material and which sleeve has a first face and a second face, said process comprising the steps of:

a. mounting said first face of said sleeve on a rotatable chuck means by means of a vacuum seal between said first device face and said chuck;

b. rotating said sleeve on said chuck means about an axis;

c. positioning a knife means substantially perpendicular to the second face of said sleeve;

d. moving said knife means in a direction substantially perpendicular to said second sleeve face whereby said knife means cuts a slit ring into said sleeve while said sleeve is rotated to form a concentric knife cut ring into said sleeve material;

e. rotating said sleeve while said knife means continues to cut a slit ring into said sleeve, said cut extending from said second face contiguous to said first face mounted on said chuck means;

f. withdrawing said knife means from said sleeve in a direction substantially perpendicular to said second face;

g. positioning said knife at another radial distance from said axis, and repeating steps d., e. and f. to form a ring section; and, h. removing said sleeve from said chuck means without removing the cut ring section from said sleeve;

the improvement comprising increasing the size of said first face to create a thin flange such that the cross-sectional area of the first face disposed against said chuck is at least 150% of the cross-sectional area of the body of said device and wherein the thin flange to be disposed against the vacuum chuck has a ridge disposed close to its outer perimeter which is received within a corresponding groove in the vacuum chuck.

4. In a process for producing at least one knife cut concentric ring section in an elastomeric sleeve formed of a pliant non metallic material and which sleeve has a first face and a second face, said process comprising the steps of:

a. mounting said first face of said sleeve on a rotatable chuck means by means of a vacuum seal between said first device face and said chuck;

b. rotating said sleeve on said chuck means about an axis;

c. positioning a knife means substantially perpendicular to the second face of said sleeve;

d. moving said knife means in a direction substantially perpendicular to said second sleeve face whereby said knife means cuts a slit ring into said sleeve while said sleeve is rotated to form a concentric knife cut ring into said sleeve material;

e. rotating said sleeve while said knife means continues to cut a slit ring into said sleeve, said cut extending from said second face contiguous to said first face mounted on said chuck means;

f. withdrawing said knife means from said sleeve in a direction substantially perpendicular to said second face;

g. positioning said knife at another radial distance from said axis, and repeating steps d., e. and f. to form a ring section; and, h. removing said sleeve from said chuck means without removing the cut ring section from said sleeve;

the improvement comprising increasing the size of said first face to create a thin flange such that the cross-sectional area of the first face disposed against said chuck is at least 150% of the cross-sectional area of the body of said device and wherein outer edges of the thin flange mate with the walls defining a corresponding recess on the vacuum chuck which secure the device against rotation relative to the chuck during working.

* * * * *